US005295630A

United States Patent [19]

Parish

[11] Patent Number: 5,295,630

[45] Date of Patent: Mar. 22, 1994

[54] GABLE-TOP TYPE CARTON AND BLANK FOR FORMING THE SAME

[75] Inventor: Marlene A. Parish, Green Bay, Wis.

[73] Assignee: James River Corporation of Virginia, Richmond, Va.

[21] Appl. No.: 827,398

[22] Filed: Jan. 29, 1992

[51] Int. Cl.[5] ..... B65D 5/08

[52] U.S. Cl. ..... 229/138; 229/106

[58] Field of Search ..... 229/106, 108.1, 138, 229/117.01, 162, DIG. 4

[56] References Cited

U.S. PATENT DOCUMENTS

| | | | |
|---|---|---|---|
| 1,876,982 | 9/1932 | Lichter . | |
| 2,177,972 | 10/1939 | Altheimer . | |
| 2,379,665 | 7/1945 | Stone . | |
| 2,666,566 | 1/1954 | Mulnix | 229/101 X |
| 2,677,993 | 5/1954 | Ens | 229/DIG. 4 |
| 2,944,721 | 7/1960 | Choate | 229/DIG. 4 |
| 3,077,295 | 2/1963 | Whiteford . | |
| 3,166,235 | 1/1965 | Schroeder | 229/106 |
| 3,337,033 | 8/1967 | Cote | 229/138 |
| 3,684,156 | 8/1972 | Fettinger et al. | 229/242 |
| 4,210,241 | 7/1980 | Mercom | 229/DIG. 4 |
| 4,243,171 | 1/1981 | Prin | 229/108.1 |
| 4,736,450 | 4/1988 | Van Erden et al. . | |
| 4,826,006 | 5/1989 | Chainard . | |
| 4,850,509 | 7/1989 | Hollenberg . | |
| 4,974,966 | 12/1990 | Fabbi . | |
| 4,991,980 | 2/1991 | Cohen et al. . | |
| 5,083,700 | 1/1992 | Mello et al. | 229/162 |

*Primary Examiner*—Allan N. Shoap

*Assistant Examiner*—Christopher McDonald

*Attorney, Agent, or Firm*—Sixbey, Friedman, Leedom & Ferguson

[57] ABSTRACT

A gable-top type carton and blank for forming the same including a front panel, a back panel, a bottom panel and first and second side walls extending between the front panel and the back panel with at least one of the side walls including a gusset forming section for permitting the front and back panels to converge towards one another from the bottom panel along a length of the side walls to an edge of the front and back panels opposite the bottom panel is disclosed. The gusset forming section includes at least one cut-out section formed in each of the side walls with the cut-out being preferably in the form of a triangle which is spatially positioned in an intermediate portion of the side wall. Extending from an apex of the triangle to an upper limit of the respective side wall is a line of weakness in the form of a perforated cut score which in turn cooperates with a base portion of the cut-out which is in the form of an arch having a radius of curvature and crease score lines of weakness extending from respective edges of the base of the triangle to form a gusset in the side walls of the carton. A closure flap is further provided along an upper edge of the front panel such that once the front and back panels are converged towards one another, the closure flap is overfolded into contact with the back panel and adhered to an outer surface of the back panel to close the carton, thus forming a carton suitable for containing articles and particularly perishable products which may be readily viewed by the consumer.

23 Claims, 5 Drawing Sheets

GABLE-TOP TYPE CARTON AND BLANK FOR FORMING THE SAME

TECHNICAL FIELD

The present invention is directed to a gable-top type carton and a blank for forming the same and more particularly, to a gable-top type carton having readily collapsible side walls for containing and displaying articles therein and a blank for forming the same.

BACKGROUND OF THE INVENTION

A variety of paperboard containers have been developed in order to contain as well as display the contents placed therein. Additionally, a variety of containers having gusseted side walls which allow the side walls to be collapsed inward such that the front and back of the carton converges toward one another from a bottom of the carton to the top of the carton have also been developed.

One such similar carton construction is illustrated in U.S. Pat. No. 2,379,665. Therein, a carton having upper and lower gusset forming sections in each side wall is disclosed such that the front and rear panels of the carton will converge towards one another to form a handle in the upper portion of the carton. However, the gusset cannot be readily formed in the side walls without jeopardizing the overall structural integrity of the carton. That is, the carton may at any time be compressed and thus collapse along fold lines 21 and 26 during the erection of the carton. Moreover, the erection, filling and sealing of a carton in accordance with that disclosed in U.S. Pat. No. 2,379,665 may not be readily carried out by automatic machinery in that the side walls may buckle with the induced stress due to the buckling jeopardizing the structural integrity of the carton.

U.S. Pat. No. 4,243,171 issued to Prin discloses a similar carton construction for carrying articles. As with the above-mentioned carton, this carton includes two sets of gusset forming sections, one being in a lower portion of the side walls and another in an intermediate position along the length of the side wall. The gusset can thus be formed to extend along the entire length of the side wall or be formed intermediate the ends of the side walls. However, because the gusset forming system includes a plurality of prescored fold lines, the side walls may tend to buckle, that is, a portion of the side wall would fold outwardly rather than inwardly along the central fold line thus destroying the integrity of the side wall as well as the accurate formation of the carton. Moreover, the carton disclosed in U.S. Pat. No. 4,243,171 is intended for use as a bag shaped box or carrier for packing and carrying articles offered, for example, by shopkeepers to their clients to carry their purchases. Such a carton is not readily adaptable to automatic machinery for erecting, filling and closing the carton.

In an effort to provide a carton for manipulation by machinery for erecting, filling and sealing cartons, a carton was developed including front, back and side panels with the side panels including perforated cut score lines extending from a point substantially adjacent the fold line between the front panel and side panel and the back panel and side panel along the bottom of the side wall and converging towards one another to a center point at the top of the side wall. However, during the formation of the carton, the side walls often buckle and bow outwardly and the stresses induced by the buckling would thus induce reverse folding and even separation along the two perforated cut score lines which define the gussets in the side walls of the carton. When such occurs, the structural integrity of the carton is significantly impaired to the point where the carton is no longer useful in containing articles.

As can be seen from the foregoing, there is clearly a pressing need for a carton of the above-mentioned type which may be reliably formed and manipulated by machinery by forming, filling and sealing such cartons, without jeopardizing the structural integrity of the carton when formed. Additionally, there is a need for a carton which conveniently presents the goods placed therein in a manner which appeals to the consumer.

SUMMARY OF THE INVENTION

It is an object of the present invention to overcome the deficiencies of the prior art. In particular, it is an object of the present invention to provide a carton which may be formed, filled and sealed by automatic machinery without jeopardizing the structural integrity of the carton.

It is a further object of the present invention to provide a paperboard blank for forming a carton which may be readily formed into a glued shell to be manipulated by automatic machinery for forming, filling and sealing the carton.

Yet another object of the present invention is to provide a carton which when formed will permit a portion of the side walls thereof to readily collapse inwardly so as to form a gable-top type carton.

A further object of the present invention is to provide a carton which, during the formation thereof, resists buckling of the side walls while readily permitting the formation of a gable-top type carton.

These as well as additional objects and advantages of the present invention are achieved by producing a paperboard carton blank including first and second panels integrally connected to one another by an intermediate first side panel with each of the first panel and second panel being hingedly connected to the first side panel by a fold line along adjacent edges thereof. A second side panel is further hingedly connected to an opposing edge of the second panel by way of a fold line with end panels hingedly connected to an edge of at least two of the first panel, second panel, first side panel and second side panel, as well as a gusset forming region in at least one of the side panels for permitting at least a portion of the side panel to collapse during formation of the carton with the gusset forming section including at least one cut-out section of the side panel. The cut-out section being in the form of a triangle which is mutually spaced from the first and second panels and intermediate the ends of the side panel. Extending from an apex of the cut-out to the upper limit of the side panel is a line of weakness in the form of a perforated cut score which permits the upper portion of the side wall to be folded inwardly into the inner space of the carton formed from the blank. The base of the triangle, being in the form of a arch, having a radius of curvature as well as lines of weakness extending from the base of the triangle to the respective edges of the side panel adjacent the first and second panels.

The carton blank is then used to form a gable-top type carton including a front panel, a back panel, a bottom panel and first and second side walls extending between the front panel and the back panel with at least one of the side walls including a gusset forming section for permitting the front and back panels to converge towards one another from the bottom panel along a length of the side walls to an edge of the front and back panels opposite the bottom panel. The gusset forming section including at least one cut-out section formed in each of the side walls with the cut-out being preferably in the form of a triangle which is spatially positioned in an intermediate portion of the side wall. Extending from an apex of the triangle to an upper limit of the respective side wall is a line of weakness in the form of a perforated cut score which in turn cooperates with a base portion of the cut-out which is in the form of an arch having a radius of curvature and crease score lines of weakness extending from respective edges of the base of the triangle to form a gusset in the side walls of the carton. A closure flap is further provided along an upper edge of the front panel such that once the front and back panels are converged towards one another, the closure flap is overfolded into contact with the back panel and adhered to an outer surface of the back panel to close the carton.

In accordance with the present invention, the lines of weakness and cut-outs formed in the side walls of the carton cooperate to form a reliable gusset forming section such that a gable-top type carton may be readily and reliably formed.

Additional advantages of the subject invention will become apparent from the figures and the following description of the preferred embodiments.

DETAILED DESCRIPTION OF THE PREFERRED EMBODIMENT

Figure 1:
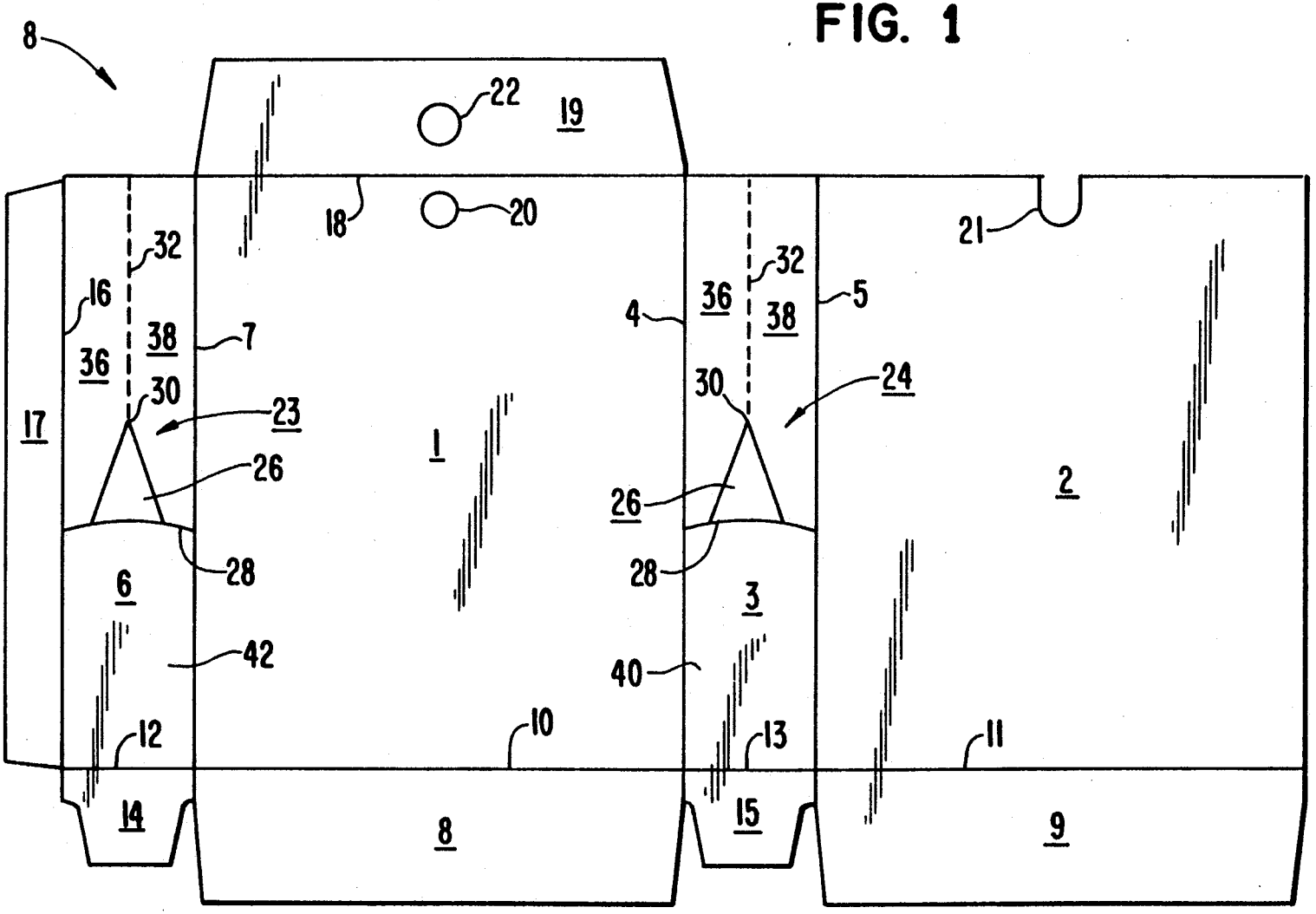
FIG. 1 is a top view of a paperboard blank used in forming the carton in accordance with a preferred embodiment of the present invention.

Referring now to the several figures and particularly to FIG. 1, there is shown a blank for forming the carton in accordance with that illustrated in FIGS. 2-5. The carton blank B of FIG. 1 includes a first or front panel 1 and a second or back panel 2. Formed integrally with each of the first panel 1 and second panel 2 is a side panel or wall 3 which is hingedly connected to each of the first panel 1 and second panel 2 by way of prescored fold lines 4 and 5. Formed integrally with and hingedly connected to the first panel 1 is a second side panel or wall 6. The side panel 6 is separated from the first panel 1 by way of prescored fold line 7. Hingedly attached to each of the first panel 1 and second panel 2 are end panels 8 and 9, these panels being hingedly connected to the first panel 1 and second panel 2 by way of prescored fold lines 10 and 11 respectively. Also hingedly connected to each of the side panels 3 and 6 by way of prescored fold lines 12 and 13 are end panels 14 and 15 respectively. The end panels 8, 9, 14 and 15 cooperating to form a bottom panel of a carton formed from the blank b.

Hingedly connected to the second side wall 6 by way of prescored fold lines 16 is a sealing flap 17, the significance of which will be set forth to greater detail hereinbelow. Further, hingedly connected to the front panel 1 by way of prescored fold line 18 is a closure flap 19. Provided in each of the front panel 1, second panel 2 and the closure flap 19 are punch-outs 20-22 respectively. It can be noted that the punch-out 21 is in the form of a slot such that it may readily align with punch-outs 20 and 22 when the carton is formed. The significance of which will be set forth in greater detail hereinbelow.

In order to form a gable-top type carton, each of the side panels 3 and 6 include gusset forming sections 23 and 24 respectively. Each of the gusset forming sections 23 and 24 are identical to one another. Accordingly, like reference numerals will be used to designate identical structural features of the gusset sections. Formed intermediate the ends of the side panels 3 and 6 are cut-outs 26. As is illustrated in FIG. 1, these cut-outs are in the form of a triangle, however, such cut-outs may be formed in several different configurations so long as the side walls is effectively weakened in this region. In accordance with a preferred embodiment of the present invention, the lower extreme or base of the cut-outs 26 are formed by prescored lines 28. This being a substantially transversely extending line of inception of the gusset forming sections 23 and 24. With the preferred embodiments, the prescored line illustrated in FIG. 1 is in the form of an arched prescored line which aids in the formation of the gable-top of the carton, however this prescored line may extend substantially parallel to the prescored lines 12 and 13. In accordance with a preferred embodiment of the invention, the arched prescored lines 28 assume a configuration having a radius or curvature equal to approximately 1 to 4 inches and preferably 2 inches. The significance of the arched prescored lines 28 will be set forth in greater detail hereinbelow.

Extending from an apex 30 of the cut-out 26 are lines of weakness 32 which extend substantially parallel to the prescored fold lines 4, 5, 7 and 16 which separate the side panels from the front panel 1, back panel 2 and sealing flap 17. In accordance with the preferred embodiment of the invention and as is illustrated in FIG. 1, the lines of weakness 32 are in the form of perforated cut score lines, however the lines of weakness 32 may be in the form of prescored fold lines, knurled prescored lines or partially cut score lines of weakness. It should be noted that if a partially cut score line of weakness is used, such partially cut score line would be formed in an inner surface of the carton blank B and cut to a depth of 15 to 85% of the paperboard thickness and preferably 50%.

Figure 2:
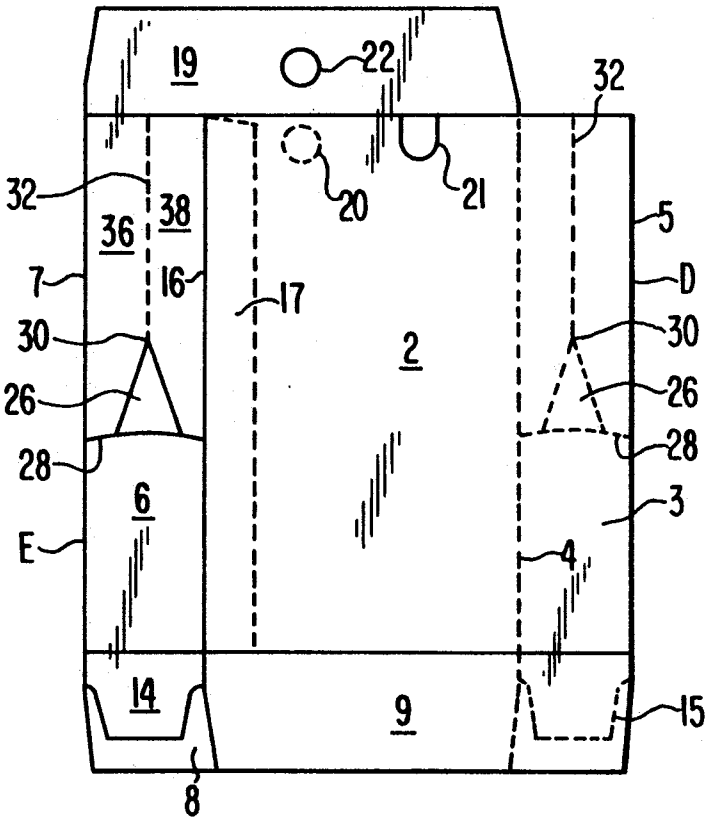
FIG. 2 illustrates the carton blank of FIG. 1 in its initial collapsed condition.
Figure 5:
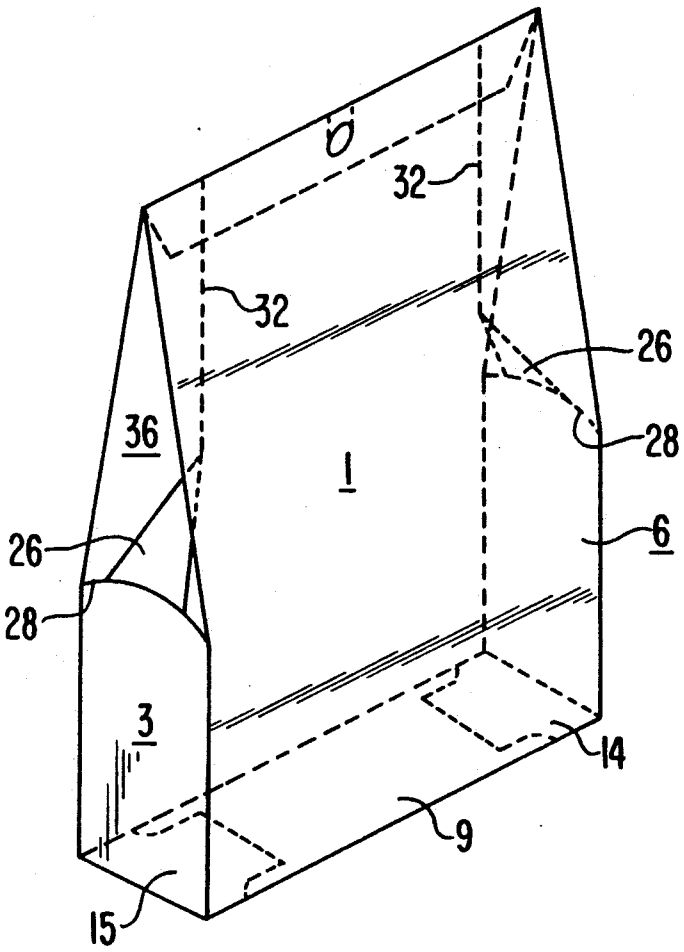
FIG. 5 is a perspective view of a fully erect and sealed carton in accordance with the present invention.

Referring now to FIG. 2, the carton blank B is initially folded into a collapsed condition forming a glued shell wherein side panel 6 including the sealing flap 17 is folded along prescored fold 7 and pivoted 180% into contact with an inner surface of the front panel 1. Once in this condition, glue is placed on an exposed surface of the sealing flap 17. The adhesive may also be applied to the sealing flap 17 or a corresponding portion of the back panel 2 prior to the overfolding of the respective panels. The back panel 2 is then folded along prescored fold line 5 and pivoted 180% into contact with the inner surface of the front panel 1 and in contact with the adhesive surface of the sealing flap 17 wherein the back panel 2 will be adhered to the sealing flap 17 forming a glued shell. Once in this condition a plurality of glued shells may be stacked one upon another and shipped for use in machinery for forming the finished cartons.

When it is desired to erect a carton in accordance with the present invention, a stack of the flat glued shells may be placed in a magazine and mechanically removed one by one from the magazine. The erection of the carton may, of course, be carried out by hand or any other conventional manner as well.

Figure 3:
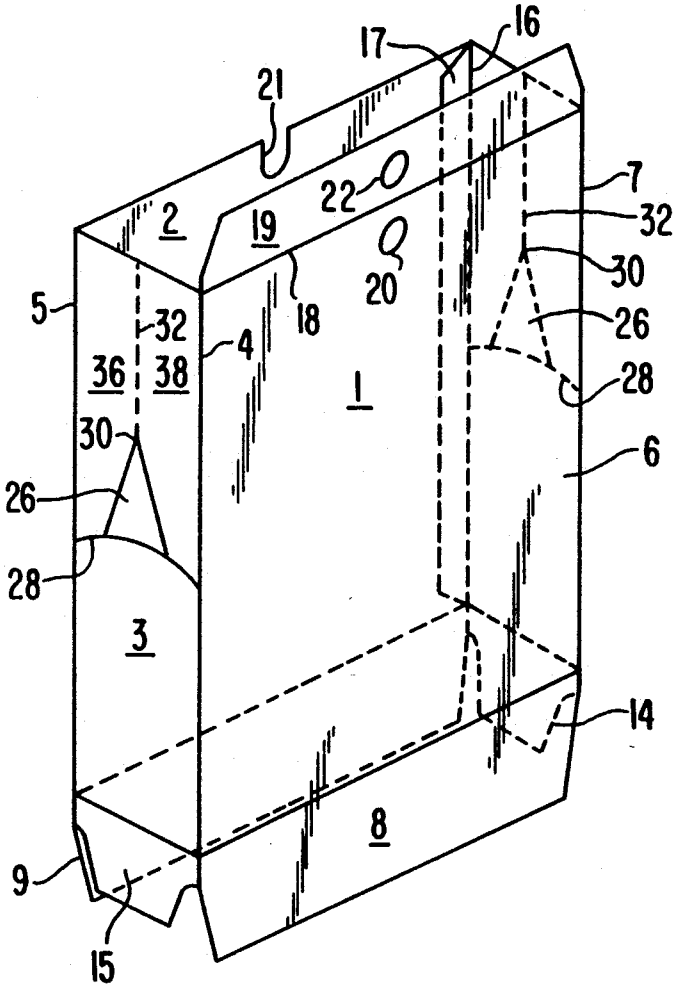
FIG. 3 is a perspective view of an initial forming step in forming the carton in accordance with a preferred embodiment of the present invention.

Generally, the glued shell when removed from a magazine will be forced into the condition illustrated in FIG. 3. In such a condition, each of the fold lines 4, 5, 7 and 16 are broken and the glued shell is formed into an erect substantially rectangular carton. In order to achieve such configuration, the edge D is urged towards the edge E which in turn breaks the prescored fold lines 4 and 16 to form a rectangular prism as illustrated in FIG. 3.

If it is desired to fill the carton from the bottom, the top of the carton should first be closed. To carry out such closure, a force is applied to the areas adjacent the line of weakness 32 pushing portions 36 and 38 into an interior of the carton and drawing the front panel 1 and back panel 2 towards one another so that these panels converge toward one another along the length of the side panels 3 and 7. This configuration being best illustrated in FIG. 4A. Due to the cut-outs 26 and the lines of inception or prescored fold lines 28, the upper portion of the carton can be readily formed into a gable or gusset-top without deforming the lower portions 40 and 42 of the side panels 3 and 6 respectively. Once in this condition, the closure flap 19 may be readily pivoted about the fold line 18 and secured to an outer surface of the back panel 2 by any known means and preferably by an adhesive applied to an undersurface of the closure flap 19. The contents of the carton may then be readily placed therein through the open bottom of the carton. These contents may be in the form of perishable consumer products such as lunch meat which are first placed in a plastic container such as a transparent bag and sealed or non-perishable articles which may be placed directly within the carton. Because the carton may include a viewing window in the form of a cut-out in the front panel 1 and includes cut-outs 26 in the side panels thereof, it is necessary to place smaller objects as well as perishable consumer items in a separate plastic container such as a transparent bag prior to their insertion into the carton.

Once the contents have been placed within the carton, the end panels 14 and 15 are then folded inwardly approximately 90% along prescored fold lines 12 and 13 respectively. An adhesive layer may then be applied to an outer surface of bottom panel 9 with this panel then being pivoted about fold line 11 approximately 90% and in contact with an outer surface of each of the end panels 14 and 15. The adhesive may also be applied to the end panel 9 prior to folding the end panels of the carton. In this condition, the end panel 8 integrally connected to the front panel 1 may be folded 90% about fold line 10 having an inner surface thereof contacting the adhesive applied to the outer surface of end panel 9, thus forming a bottom panel of the container. Generally, the formation of the carton, insertion of the contents therein and closing of the carton is carried out with the carton in a horizontal position. However, the carton may be formed, filled and sealed in any orientation so long as the structural integrity of the carton is maintained. Further, any known adhesive including hot melt adhesive may be used in adhering the various panels to one another.

Figure 4A:
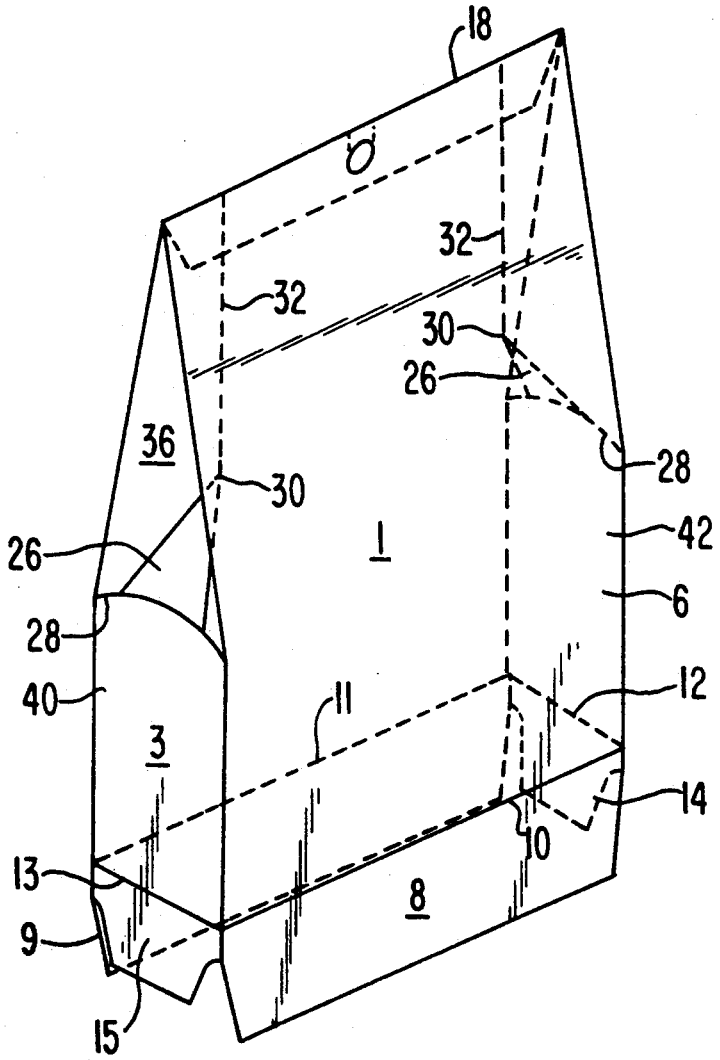
FIG. 4A is a perspective view illustrating a further step in forming the gable-top carton in accordance with a preferred embodiment of the present invention.
Figure 4B:
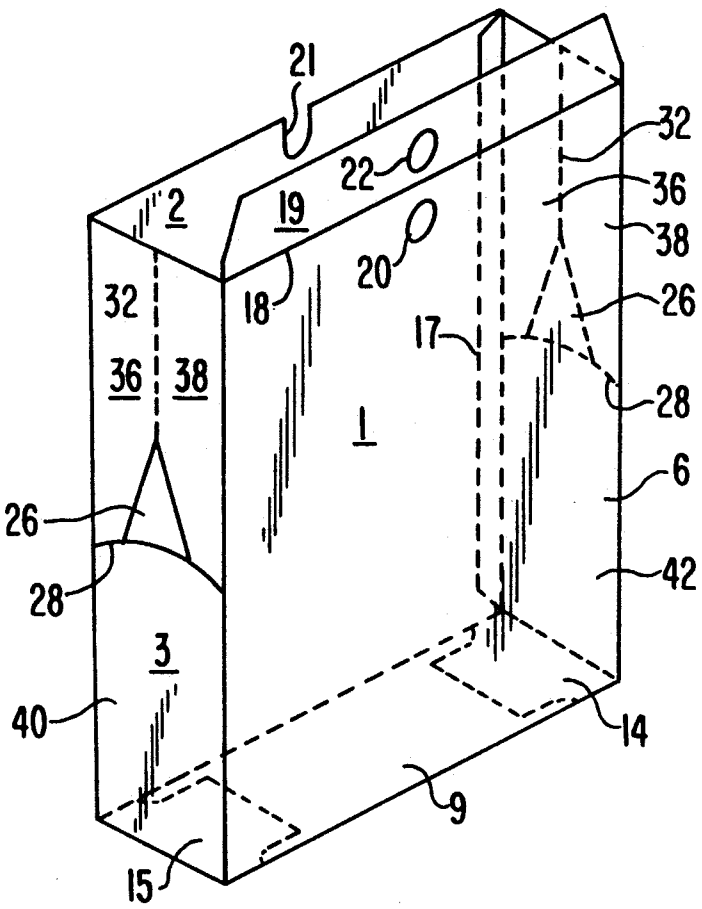
FIG. 4B is a perspective view illustrating a further step in forming the gable-top carton in accordance with an alternative embodiment of the present invention.

An alternative to the aforementioned manipulation of the several panels forming the carton is illustrated in FIG. 4B. In FIG. 4B, the bottom panel of the carton formed by end panels 8, 9, 14 and 15 is formed in accordance with that procedure set forth hereinabove, however the bottom is closed prior to the insertion of contents into the carton. Once the bottom has been secured, the contents may be readily placed into the carton through the top opening thereof. Once the contents have been placed therein, the portions 36 and 38 of the side panels 3 and 6 are moved into an interior of the container by applying a force or about the lines of weakness 32. In doing so, a fold is readily created along the line of weakness permitting the front panel 1 and back panel 2 to collapse and converge towards one another and form a gable or gusset-top of the carton as with the previous embodiment. Again, the cut-out 26 in conjunction with the prescored fold line 28 permits the upper portion of the side walls 3 and 6 to collapse while maintaining the structural integrity of the remaining portions 40 and 42 of the side walls 3 and 6 respectively. Once the front panel 1 and back panel 2 have been collapsed by the formation of the gable or gusset in the side walls 3 and 6, the closure flap 19 can then be folded about prescored fold line 18 so that such closure flap can be adhered to an outer surface of the back panel 2. This may be carried out in a conventional manner, however with the preferred embodiment, an adhesive layer is applied to a surface of the closure flap 19 which contacts the outer surface of the back panel 2 and is adhered thereto. As can be seen from FIG. 5, the holes 20, 21 and 22 align appropriately when the carton is in the closed condition so that the carton may be readily hung for display purposes.

Figure 6:
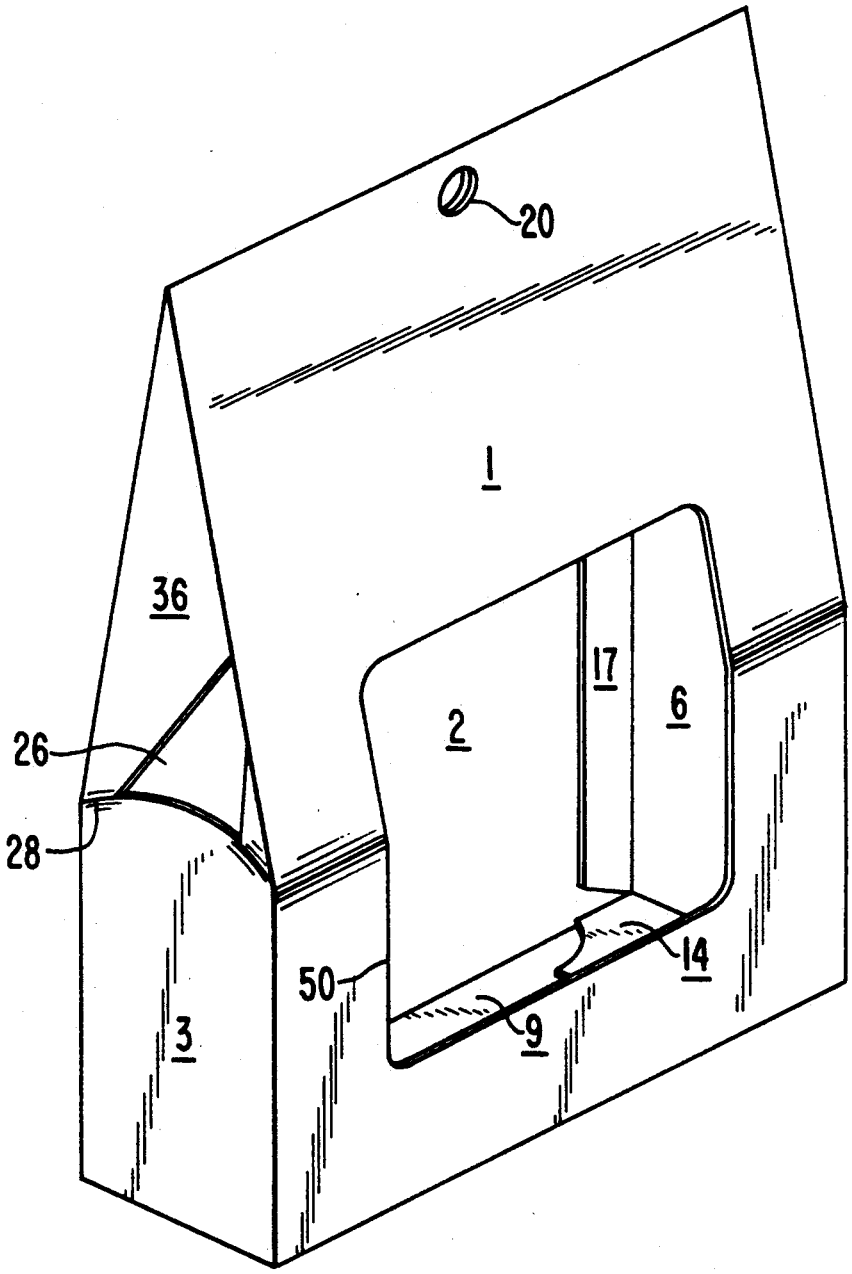
FIG. 6 is a perspective view of the carton formed in accordance with the invention including a viewing window viewed therein.

Referring now to FIG. 6, the carton formed in accordance with the present invention is illustrated therein. As can be seen from FIG. 6, the carton includes a gable or gusset formed in an intermediate position about each of the side walls 3 and 6 with the gusset being formed by way of the cut-out 26 in conjunction with the prescored fold line 28 and the lines of weakness. When a force is applied to the side wall in the region about the lines of weakness, the gable or gusset is readily formed therein without jeopardizing the structural integrity of the remainder of the side walls 3 and 6. Also, as is illustrated in FIG. 6, a cut-out or window 50 is formed in the front panel 1 of the carton. In doing so, the contents of the carton may be readily viewed by the consumer. As previously set forth, when the contents placed within the carton are in the form of perishable consumer items, such contents are packaged in a separate transparent bag in order to maintain the freshness of the contents while permitting such contents to be readily viewed through the window 50.

While the present invention has been described in connection with a carton of the above-mentioned type, the disclosed gable or gusset-forming structure may be provided on any type carton where it is desired to collapse a portion of the side wall panels in order to converge the main panels towards one another. Moreover, a handle may be formed in an upper portion of each of the front panel 1 and back panel 2 such that when the front panel 1 and back panel 2 are converged towards one another, a single handle may be formed so as to permit the carton to be readily carried.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention be limited only by the appended claims.

Industrial Applicability

The above-described gable or gusset-forming structure may be incorporated in any paperboard type carton wherein it is desired to converge front and back panels of the carton towards one another while maintaining ample space within the carton for accommodating the contents. The present invention is particularly suitable for containing perishable consumer products such as lunch meat or the like which may be readily viewed by the consumer prior to purchase.

What is claimed is:

1. A carton comprising:

a front panel;

a back panel;

a bottom panel; and first and second sidewalls extending between said front panel and said back panel, at least one of said sidewalls including a gusset forming means for permitting said front and back panels to converge toward one another from a substantially transverse line of inception formed along a length of said one of said sidewalls to an edge of said front and back panels opposite said bottom panel;

said gusset forming means including at least one cut-out section in said one of said sidewalls and spaced from said bottom panel and a line of weakness extending from said cut-out section to an upper limit of said one of said sidewalls wherein a base of said cut-out section is substantially positioned on said line of inception.

2. A carton as defined in claim 1, wherein each of said side walls includes said gusset forming means.

3. A carton as defined in claim 2, wherein said cut-out section is in the form of a triangle wherein the base of said triangle is spaced from said front and back panels.

4. A carton as defined in claim 3, wherein an apex of said triangle is mutually spaced from said front panel and said back panel.

5. A carton as defined in claim 4, wherein said line of weakness formed in each respective sidewall extends from said apex to said upper limit of said respective sidewall.

6. A carton as defined in claim 5, wherein said line of weakness is a perforated cut score.

7. A carton as defined in claim 5, wherein said line of inception is in the form of an arc having a radius of curvature and extending in a direction toward said apex.

8. A carton as defined in claim 7, wherein said line of inception includes lines of weakness extending from said base of said triangle to respective edges of said side wall adjacent said front and back panels.

9. A carton as defined in claim 8, wherein said lines of weakness extending from said base of said triangle are crease score lines.

10. A carton as defined in claim 8, wherein said lines of weakness extending from said base form an extension of said base and are of substantially the same radius of curvature as said base.

11. A carton as defined in claim 1, further comprising a closure means for closing the carton, said closure means including a closure flap hingedly connected to said edge of said front panel opposite said bottom panel, wherein said closure flap overlies and adheres to an outer surface of said back panel when said gusset is formed and said front and back panels converge toward one another.

12. A blank for forming a carton, said blank comprising:

first and second panels integrally connected to one another by an intermediate first side panel, each of said first panel and said second panels being hingedly connected to said first side panel by a fold line along adjacent edges thereof;

a second side panel hingedly connected to an opposing edge of said second panel by a fold line;

end panels hingedly connected to an edge of at least two of said first panel, said second panel, said first side panel and said second side panel; and a gusset forming means in at least one of said side panels for permitting at least a portion of said side panel to collapse during formation of the carton, said gusset forming means including at least one cut-out section in said one of said side panels having a base thereof substantially positioned on a substantially transversely extending line of inception of a gusset formed by said gusset forming means spaced from said end panel and a line of weakness extending from said cut-out section to an upper limit of said one of said side panels.

13. A blank as defined in claim 12, wherein each of said side panels includes said gusset forming means.

14. A blank as defined in claim 13, wherein said cut-out section is in the form of a triangle wherein the base of said triangle is spaced from said front and back panels and said bottom panel.

15. A blank as defined in claim 13, wherein an apex of said triangle is mutually spaced from said first panel and said second panel.

16. A blank as defined in claim 15, wherein said line of weakness formed in each respective side panel extends from said apex to said upper line of said respective side panel.

17. A blank as defined in claim 16, wherein said line of weakness is a perforated cut score.

18. A blank as defined in claim 17, wherein said line of inception is in the form of an arc having a radius of curvature and extending in a direction toward said apex.

19. A blank as defined in claim 18, wherein said line of inception includes lines of weakness extending from said base of said triangle to respective edges of said side panel adjacent said first and second panels.

20. A blank as defined in claim 19, wherein said lines of weakness extending from said base of said triangle are crease score lines.

21. A blank as defined in claim 20, wherein said lines of weakness extending from said base form an extension of said base and are of substantially the same radius of curvature as said base.

22. A blank as defined in claim 12, further comprising a sealing means hingedly connected to an edge of said second side panel opposing said second panel, wherein said sealing means adheres to an edge of said first panel opposing said first side panel when the blank is formed into a carton.

23. A blank as defined in claim 12, further comprising a closure means for closing the carton formed from the blank, said closure means including a closure flap hingedly connected to an edge of said second panel opposite said end panel, wherein said closure flap overlies and adheres to an outer surface of said first panel when said gusset is formed and said second and first panels converge toward one another when the carton is formed from the blank.

* * * * *